US005816946A

United States Patent [19]

Grossman

[11] Patent Number: 5,816,946

[45] Date of Patent: Oct. 6, 1998

[54] PORTABLE SAFETY SYSTEM FOR ISOLATING ON-DECK BATTER

[76] Inventor: Bennett S. Grossman, 1797 Echo Place, Merrick, N.Y. 11566

[21] Appl. No.: 560,792

[22] Filed: Nov. 21, 1995

[51] Int. Cl.[6] ..... A63B 69/00

[52] U.S. Cl. ..... 473/451; 473/421; 256/1; 49/34; 160/332

[58] Field of Search ..... 256/31, 1, 47, 256/23; 160/332, 350, 351; 49/34; 273/26 A, 25, 26 R; 473/421, 451

[56] References Cited

U.S. PATENT DOCUMENTS

| | | | |
|---|---|---|---|
| 286,461 | 10/1883 | McOmber | 256/23 |
| 2,451,431 | 10/1948 | Bible | 256/23 |
| 2,823,034 | 2/1958 | Bingham, Jr. . | |
| 2,906,507 | 9/1959 | Hodson | 256/1 |
| 2,923,547 | 2/1960 | Heeremans . | |
| 3,222,067 | 12/1965 | Litwhiler et al. . | |
| 3,593,997 | 7/1971 | Boehner . | |
| 3,849,935 | 11/1974 | Hale | 49/34 |
| 3,891,189 | 6/1975 | Russo | 256/1 |
| 4,072,295 | 2/1978 | Roberts . | |
| 4,290,712 | 9/1981 | Hayes | 256/1 |
| 4,524,953 | 6/1985 | Phillips et al. . | |
| 4,733,865 | 3/1988 | Reed . | |
| 4,844,420 | 7/1989 | Oster | 49/34 |
| 4,969,651 | 11/1990 | Comartin . | |
| 5,050,846 | 9/1991 | Goodman et al. | 49/34 |
| 5,100,108 | 3/1992 | Schultz | 256/23 |
| 5,402,999 | 4/1995 | Keehn, Sr. | 256/45 |
| 5,484,137 | 1/1996 | Smith | 256/1 |
| 5,501,429 | 3/1996 | Sakuma | 49/34 |
| 5,542,648 | 8/1996 | Cohen | 256/45 |

*Primary Examiner*—Mark S. Graham
*Attorney, Agent, or Firm*—Cowan, Liebowitz & Latman, P.C.

[57] ABSTRACT

Portable safety system for isolating an on-deck batter during a baseball or softball game comprises one or more poles, a length of cord long enough to surround an on-deck area, structure to support the cord and a fastening system for fastening the ends of the cord to the poles or to each other. The safety system may be free-standing and entirely supported by poles, or partly supported by a backstop commonly found on baseball fields in addition to one or more poles. The poles may have holes, brackets, a spring loaded roller, or part of a hook and loop system to support the cord. The fastening system comprises hooks, hook and loop material, or similar structures. The poles also contain structural elements to help in securely wrapping the cord around the poles for storage and transport. The safety system is lightweight, portable, inexpensive, and easy to assemble and disassemble.

31 Claims, 11 Drawing Sheets

FIG. 7
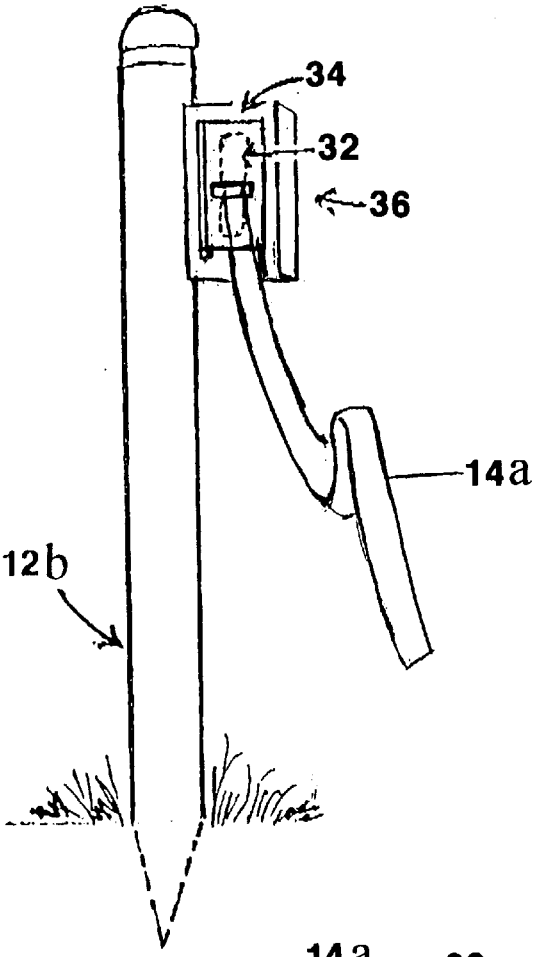
FIG. 8a
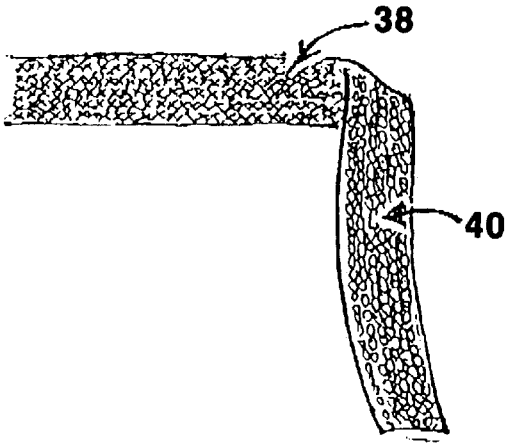
FIG. 8b
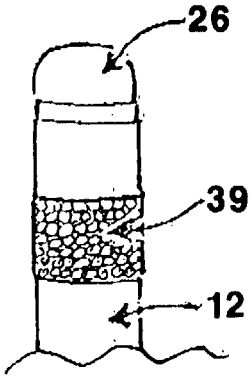
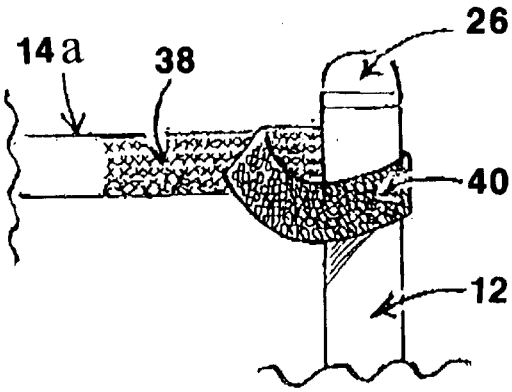
FIG. 8c

PORTABLE SAFETY SYSTEM FOR ISOLATING ON-DECK BATTER

BACKGROUND OF THE INVENTION

The invention disclosed herein relates to a portable safety system for isolating an on-deck batter during an amateur baseball or softball game.

While a baseball game is in progress and one person is at bat, the on-deck batter, i.e. the next person to bat, takes practice swings to prepare for his or her turn at bat. In professional baseball games, such as Major League Baseball games, the on-deck batter stands in a designated area called the "on-deck circle," an area of the field in foul territory on which a circle is drawn. Spectators are not permitted onto the field, and the movement of personnel on the field is largely controlled so that other players, umpires, bat boys, ground crew, etc. seldom walk near the on-deck circle.

During amateur baseball or softball games, however, the movement of personnel on the field is largely uncontrolled so that players and spectators frequently walk by an area being used as an on-deck circle. Moreover, there is generally limited space available in foul territory for an on-deck area so that typically the on-deck area is in a part of the field occupied or frequented by the rest of the team at bat, coaches for both teams, and spectators. As a result, a danger arises that the on-deck batter taking practice swings in an on-deck area will accidentally strike another person with the bat, causing potentially serious injury.

This danger is particularly prevalent in little league games, because children are less careful where they swing a bat and where they stand or walk while others are swinging a bat. In fact, the danger of injury is so serious that at the 20th International Congress of Little League Baseball, held in March, 1995 in Reno, Nevada, the delegates voted by an overwhelming majority (78%) to approve an amendment to the official rules to prohibit the on-deck position. The International Congress, which meets once every three years, determines rules for approximately 196,000 little league teams worldwide, in which about three million children play.

To the inventor's knowledge, no device portable or otherwise is available for protecting participants and spectators at amateur baseball games from serious injury resulting from accidental contact with a bat being swung by an on-deck batter. As illustrated quite clearly by the 20th International Congress' recent vote to ban the on-deck position in little league games, there is an unfilled need for a device or system to provide this type of protection. The present invention provides the heretofore missing protection by providing an effective, lightweight, portable, easy-to-use, and relatively inexpensive system for isolating the on-deck batter taking practice swings.

SUMMARY OF THE INVENTION

It is an object of the present invention to provide a system for protecting players, participants, and spectators in a baseball game from potentially serious injury caused by accidental contact with a baseball bat being swung by an on-deck batter.

It is another object of the present invention to provide a system for isolating an on-deck batter which is portable, lightweight, and easy to wrap up and carry in conventional baseball equipment bags, and in an automobile trunk.

It is another object of the present invention to provide a system for isolating an on-deck batter which may be assembled and disassembled quickly, easily, and without the need for any special tools or equipment.

It is another object of the present invention to provide a system for isolating an on-deck batter which is adjustable depending on the size and shape of the protected area desired or otherwise available.

It is another object of the present invention to provide a system for isolating an on-deck batter which is relatively inexpensive and thus available for purchase by teams and individuals at any level of play, whether organized or otherwise.

The above and other objects are achieved by a portable safety system for isolating an on-deck batter during a baseball or softball game. The safety system comprises one or more poles each having anchoring structure at a lower end thereof for supporting the pole in an upright position and having supporting structure at least about three feet from the lower end for supporting one or more flexible elements passing therepast or terminating thereat when the system is assembled. The system also contains one or more flexible elements, such as cord, rope, ribbon, fabric, belt, tape, elastic, screen, etc., and a fastening system to releasably attach the one or more ends of the flexible element(s) to the pole(s), to a preexisting upright structure such as a backstop, or to one another.

The flexible elements supported by the poles provides a clear visual and physical reminder to other players, participants, and spectators standing in foul territory to avoid the on-deck area and to stand a sufficient distance away from the on-deck batter to avoid being struck by the bat. The on-deck area isolated by the safety system is large enough to contain at least one location at which an on-deck batter can stand and swing a baseball bat such that the baseball bat does not extend beyond the on-deck area at any point in the swing and does not strike the flexible elements.

In some embodiments, the flexible elements are supported by both the pole(s) and the backstop. The flexible elements can extend between two or more adjacent poles and between two of the poles and the backstop, and the on-deck area will then have four or more sides. Alternatively, the flexible elements can extend in two segments between a single pole and two spaced apart points on the backstop, thus providing a triangular configuration. In these embodiments, the on-deck area is defined by the length of the flexible elements and the portion of the backstop between the two spaced apart points.

In other embodiments, the system is free-standing and comprises three or more poles having structure for supporting one or more flexible elements passing therepast or terminating thereat at least about three feet from the lower end of the poles. In these embodiments, the flexible elements must cumulatively have a length sufficient to enclose the on-deck area.

A variety of possible structures may be used to support the flexible elements from the poles, including holes, slots, brackets, hook and eye arrangements, a spring loaded roller, or hook and loop material (e.g., Velcro). Possible variations for the fastening system include hooks attached to the ends of the flexible elements and Velcro.

The anchoring structure at the lower end of each pole comprises a configuration of the lower end and/or a structure attached to the lower end to engage the ground. For example, the lower end may simply be tapered, spiked, or pointed, or may be attached to a base from which one or more spikes or the like extend downwardly into the ground.

To facilitate the storage of the safety system, at least one of the poles has structure which engages one or more of the flexible elements spaced longitudinally along the pole as said flexible elements are wrapped along said at least one pole for storage. The structure may comprise L-shaped hooks, welded brackets, hook and loop material (e.g., Velcro), or similar structural elements. Alternatively, the ends of the flexible elements may contain a swath of hook material on one side and a swath of complementary loop material on the opposite side so that the two sides of the ends may be secured to one another around the pole at any location.

BRIEF DESCRIPTION OF THE DRAWINGS

The invention is illustrated in the figures of the accompanying drawings which are meant to be exemplary and not limiting, in which like references refer to like or corresponding parts, and in which:

FIG. 7 shows a pole according to another embodiment of the invention which has attached thereto a spring loaded roller for dispensing a flexible element in the form of flat ribbon or tape;

FIG. 8*a* shows the end of a piece of flexible element in the form of tape in one embodiment of the invention having a swath of hooks on one side and a swath of complementary loops on the other;

FIG. 8*b* shows the top of a pole to which a swath of either hook or loop material is attached;

FIG. 8*c* shows the end of the tape shown in FIG. 8*a* wrapped around the top of a pole;

DETAILED DESCRIPTION OF THE PREFERRED EMBODIMENTS

Figure 1:
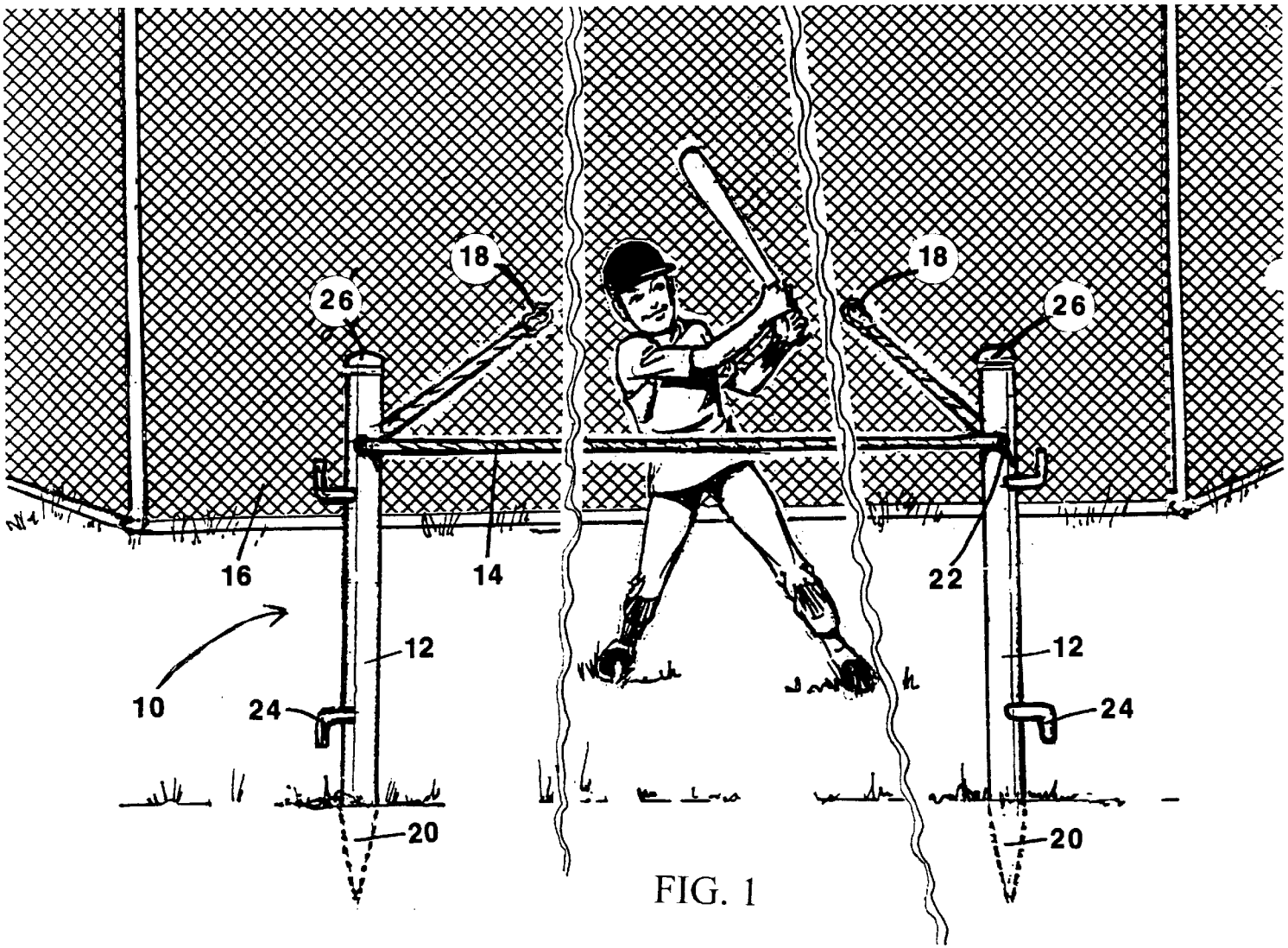
FIG. 1 is a perspective view (shown in broken form to reduce width of view) of one embodiment of a safety system of the present invention, shown in an assembled condition attached to a backstop or batting cage and in use by an on-deck batter, with the lower ends of the poles inserted in the ground shown in dotted lines.

Two general arrangements of the portable safety system according to the present invention are illustrated in the drawings, one of which utilizes a backstop to help support the system and another of which is free standing.

With reference to FIG. 1, one preferred embodiment of the safety system 10 comprises two poles 12, a length of cord 14 which is supported by the poles 12 and a backstop 16, and a pair of hooks 18 to attach the ends of the cord 14 to the backstop 16. The system 10 is assembled behind the backstop 16, so that an on-deck batter can take practice swings while the current batter (not shown) bats in front of the backstop 16. The poles 12 are made of a sturdy, lightweight material such as aluminum, wood, fiberglass, plastic, etc. The cord 14 is any strong, flexible, and moderately stretchable material such as twisted fibers, fabric, rubber, wire, tape, ribbon, etc., and may be a long, single cord or a number of shorter, separate cord segments attached to each other or to the poles 12. The backstop 16 is usually a conventional chain link or chicken wire fence which is a permanently established on the baseball field behind home plate. However, the system 10 may also be assembled along any other suitably located fence or structure in foul territory on or adjacent to the playing field.

The poles 12 are sufficiently long to support the cord at a height which is clearly visible, but not too long so as to become heavy and cumbersome. In the preferred embodiment for use in little league, the poles 12 are about four feet long, and support the cord at a height of about three feet from the ground. The lower ends 20 of the poles 12 are shaped as inverted cones so that the poles may be wedged or forced into the type of relatively soft soil normally found in or near baseball fields. The lower ends 20 are sufficiently long so as to anchor the poles 12 in place in an upright position. In a preferred embodiment, the lower ends 20 of the poles 12 are about four or five inches long. Alternative shapes for the lower ends 20 are of course possible, but should preferably contain a point on the bottom to facilitate their insertion into the ground. For example, referring to FIG. 2*b*, the pole 12 may have a base 21 with one or more spikes 23 extending downwardly therefrom which are pushed into the ground. Other structures will be apparent to those of skill in the art.

Figure 2:
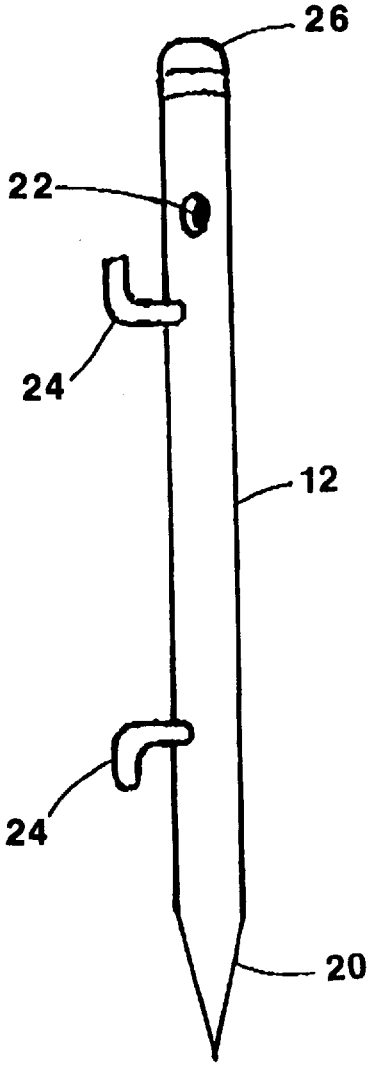
FIG. 2 shows one pole used in the system of FIGS. 1, 4, or 5.
Figure 2B:
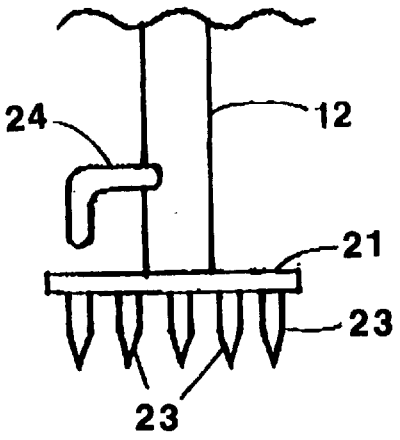
FIG. 2*b* shows another embodiment of the lower end of a pole used in the system.

With reference to FIGS. 1 and 2, each pole 12 also contains a hole 22 about three feet from the bottom of the pole 12 sized to accept the cord 14. Two L-shaped hooks 24 are attached to the pole 12 near the top and bottom thereof and aligned in opposite directions. The cord 14 may be wrapped around the hooks 24 to prepare the system for storage or transport (see FIG. 3). Each pole 12 also has a rounded cap 26 on top to minimize the likelihood of potential injury resulting from sharp edges on the top of the pole 12 and to provide a surface which may be struck with a hammer or baseball bat in order to force the bottom 20 of the pole 12 into the ground.

Figure 4:
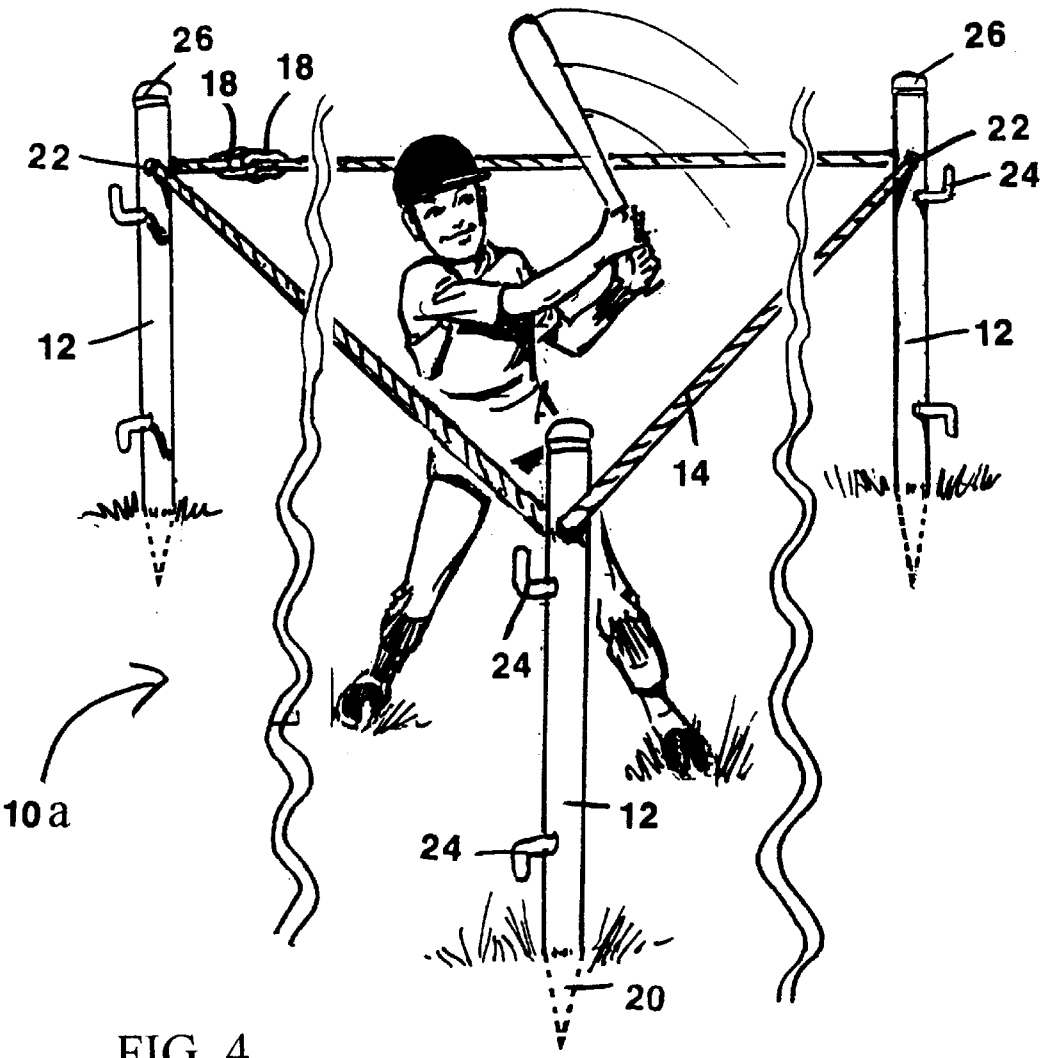
FIG. 4 is a perspective view (shown in broken form to reduce width of view) of one embodiment of a free-standing safety system of the present invention having three poles, shown in an assembled condition and in use by an on-deck batter, with the lower ends of the poles inserted into the ground shown in dotted lines.
Figure 5:
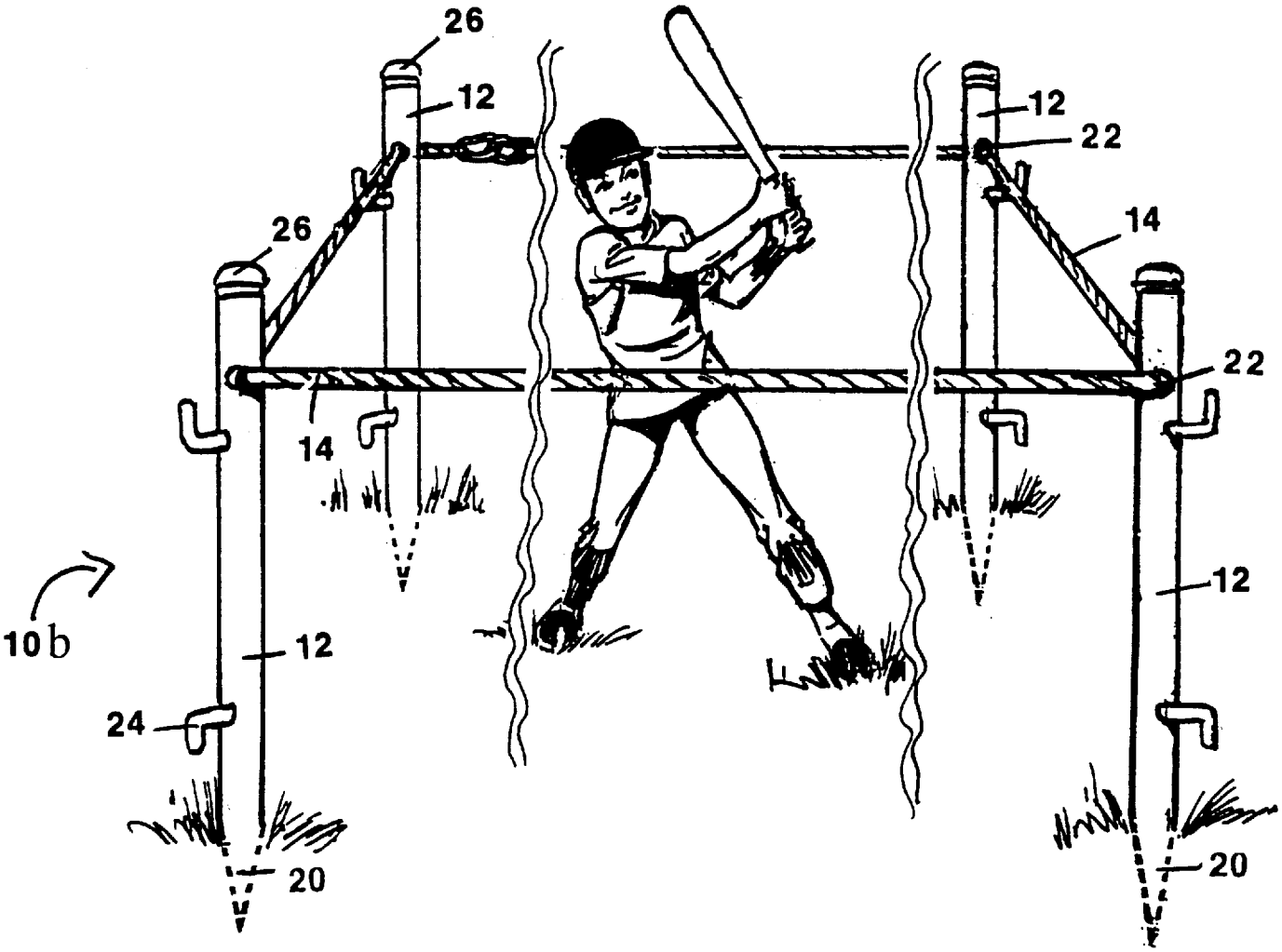
FIG. 5 is a perspective view (shown in broken form to reduce width of view) of another embodiment of a free-standing safety system having four poles, shown in an assembled condition and in use by an on-deck batter, with the lower ends of the poles inserted into the ground shown in dotted lines.

The system is assembled by anchoring the poles 12 into the ground in a spaced relationship to one another and to the backstop, so that the poles and one or two points on the backstop define the vertices of an on-deck area large enough to isolate the on-deck batter. The poles are anchored into the ground by forcibly pushing or banging the tops 26 of the poles 12 until the lower ends 20 are completely submerged in the ground. The on-deck area is large enough so that if the on-deck batter stands in a central location within the area and swings the bat, the bat will not extend beyond the area in any direction. As a result, the on-deck batter may swing the bat without risk of interference from the cord 14 and without risk of striking someone standing near the on-deck area. For little league baseball, the outer perimeter of the area should be distanced by at least about four feet in all directions from the central location, and preferably slightly more to account for batters who step in while swinging. The views of the system in FIGS. 1, 4, and 5 are shown in broken form to reduce the widths of the views and to indicate that the system is adequately sized to isolate an on-deck batter. The central location may be marked on the ground using lime or powdered chalk once the safety system has been assembled.

Once the poles 12 are securely anchored to the ground, the cord 14 is inserted through the holes 22. Alternatively, the cord 14 may be strung through the holes 22 before the poles 12 are anchored. Each end of the cord 14 is then attached to a hook 18 which is then detachably connected to the backstop 16. Alternatively, the hooks 18 are pre-attached to the ends of the cord 14 and are either small enough to pass through the holes 22, or the cord 14 is pre-strung through the holes 22. If the cord 14 is not taut when the system is assembled, one or both of the poles 12 may be moved until the cord 14 is taut. The use of the backstop 16 to support the cord 14 helps to minimize the number of poles 12 needed in the system and to shorten the length of cord 14 needed to surround the on-deck area.

As an alternative to the two pole embodiment shown in FIG. 1, the safety system may contain three or more poles to give the on-deck area more sides, thus making it closer to the circular shape defined by a swinging bat. Alternatively, the system may contain one pole and define a triangular on-deck area similar in shape to the on-deck area defined by the free-standing embodiment illustrated in FIG. 4. As yet a further alternative, the ends of the cord 14 may be strung through the spaces in the chain links in the backstop 16 and fastened either to a pole 12 or to each other, as shown in the embodiments illustrated in FIGS. 4 and 5. This alternative may be particularly useful when utilizing the spring-loaded cord shown in FIG. 7, which has only one free end.

Figure 3:
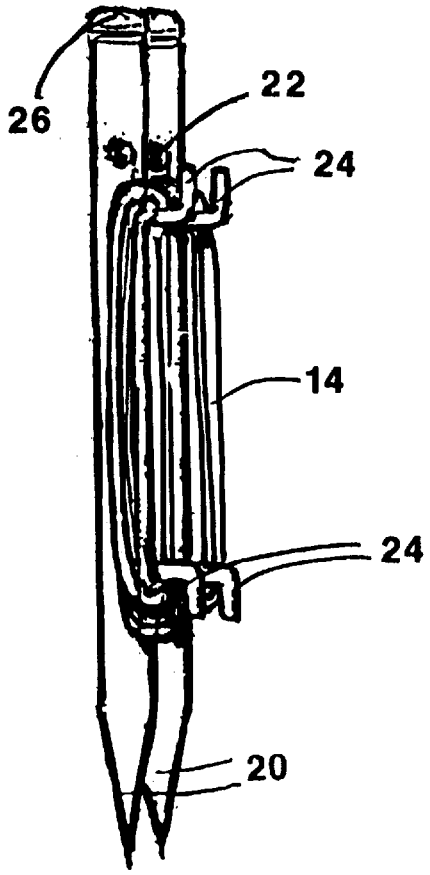
FIG. 3 shows the safety system of FIG. 1 in a wrapped condition suitable for storage and transport.

As shown in FIG. 3, to store and carry the safety system, the elements of the system are wrapped by placing the two poles 12 side by side and tightly wrapping the cord 14 around the hooks 24. The ends of the cord 14 are secured by interlocking the hooks 18 at the ends of the cord or attaching each end of the cord 14 to one of the hooks 24 to prevent unraveling. The cylindrical shape of the poles 12 facilitate their transport in a conventional baseball equipment bag, such as a duffel bag, which is shaped to carry similarly shaped baseball bats.

FIGS. 4 and 5 illustrate two preferred embodiments of a portable safety system of the present invention which is free standing, i.e., does not require the use of a backstop to support the cord. In FIG. 4, the safety system 10*a* comprises three poles 12, a cord 14, and hooks 18, all of the same type described above. The three poles 12 are assembled and anchored so as to define an on-deck area, the cord 14 is strung through the holes 22 in the poles 12, and the hooks 18 are interconnected. The safety system 10*b* of FIG. 5 comprises four poles 12 and defines a larger on-deck area than the system 10*a* in FIG. 4. Of course, any number of poles may be used to define an on-deck area of desired size and shape.

Figure 6:
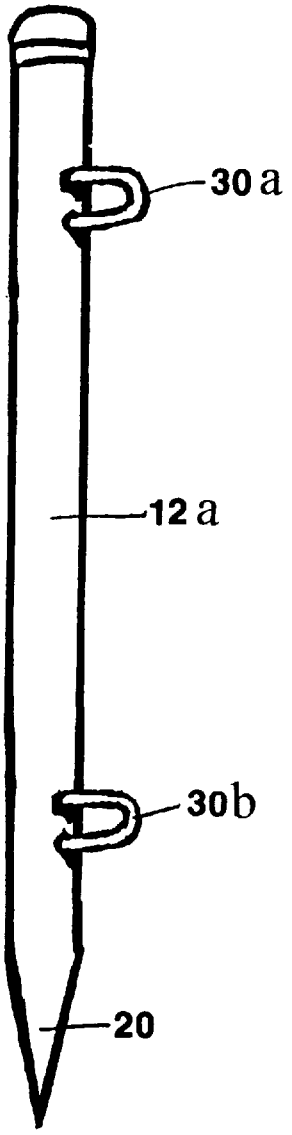
FIG. 6 shows another embodiment of a pole.
Figure 6A:
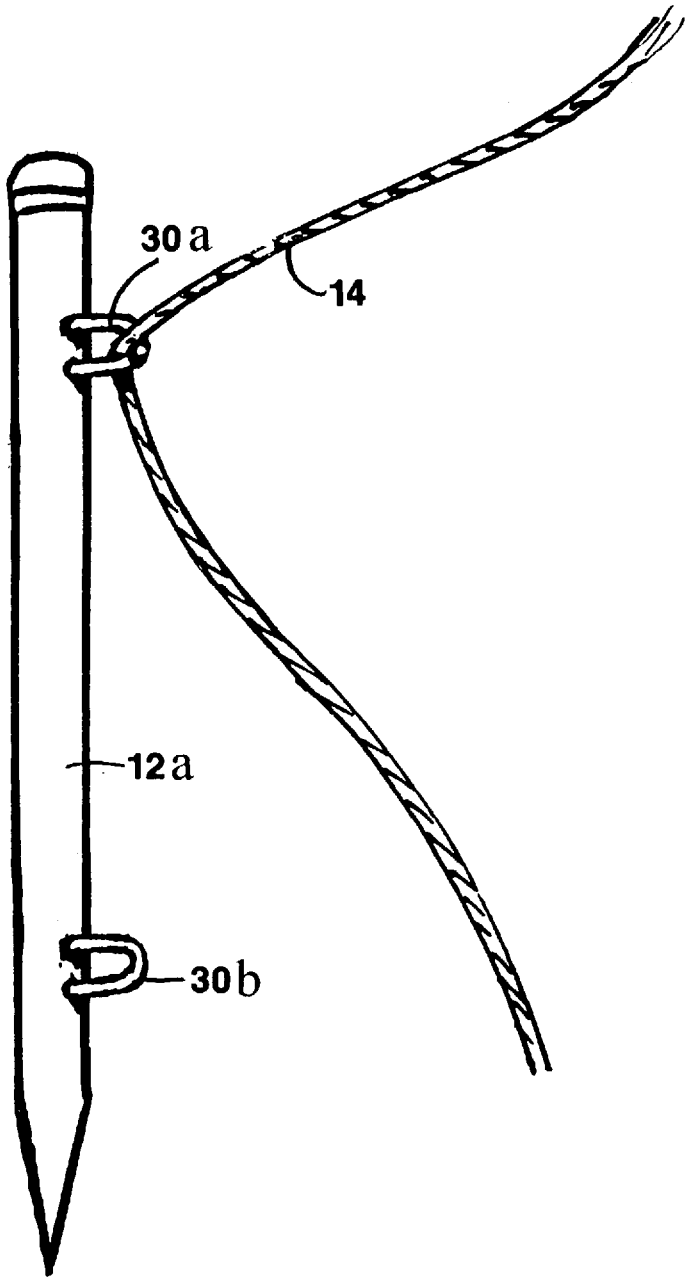
FIG. 6*a* shows the pole of FIG. 6 with a flexible element in the form of a cord strung through a bracket.
Figure 6B:
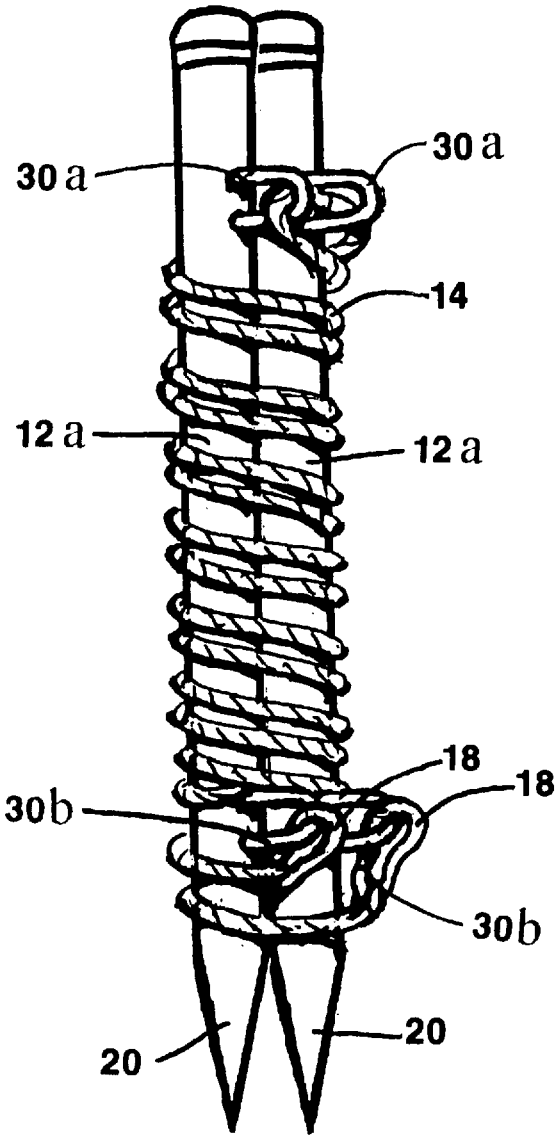
FIG. 6*b* shows one embodiment of the safety system of the present invention using two poles of the type shown in FIG. 6 in a wrapped condition suitable for storage or transport.

Some alternative embodiments of the flexible element(s), of the structures in the poles for supporting and wrapping the flexible element(s) (for storage and transport), and of the system for fastening the flexible element(s) are shown in FIGS. 6–9. As shown in FIG. 6, the holes 22 and L-shaped hooks 24 may be replaced by a pair of brackets 30*a* and 30*b* spaced apart near the top and bottom of the pole 12*a*. The brackets 30*a* and 30*b* may be securely attached to the pole 12*a* in any conventional manner, including welding, nailing, etc. As shown in FIG. 6*a*, the cord 14 is strung through the top bracket 30*a* and supported therein in an assembled condition of the safety system. As shown in FIG. 6*b*, the cord 14 is wrapped (for storage and transport) around two adjacent poles 12*a* by inserting it through the pair of adjacent top brackets 30*a*, winding it around the circumference of the poles 12*a* a number of times, and fastening the hooks 18 to the pair of bottom brackets 30*b*.

The brackets 30*a* may be made large enough so that each simultaneously supports two cords. This can be used simply to provide the effect of widening the cord, or so that two adjacent on-deck areas may be cordoned off using one or more common poles between them.

As shown in FIG. 7, a spring loaded roller 32 containing a roll of flat ribbon or tape 14*a* may be attached to pole 12*b*. The roller 32 is contained within a housing 34, and the tape 14*a* is fed through a suitably sized slot 36 in the housing 34. The tape is preferably about 2 inches wide. The other poles, if any, in the safety system may contain structure as described above for supporting the tape 14*a* in the assembled condition of the system. Use of the spring loaded roller shown in FIG. 7 obviates the need for additional structure such as hooks or brackets for wrapping the cord 14*a* for storage.

As another alternative to the use of holes 22 or brackets 30*a*, swaths of hook and loop material, such as Velcro, may be used to secure the tape 14*a* to the poles. As shown in FIGS. 8*a* and 8*b*, a swath 38 of either hook or loop material may be placed on the inside of the tape 14*a*, and a swath 39 of the complementary material may be attached along the outside of the top of the pole 12 at the location described above for the holes or brackets.

Figure 8D:
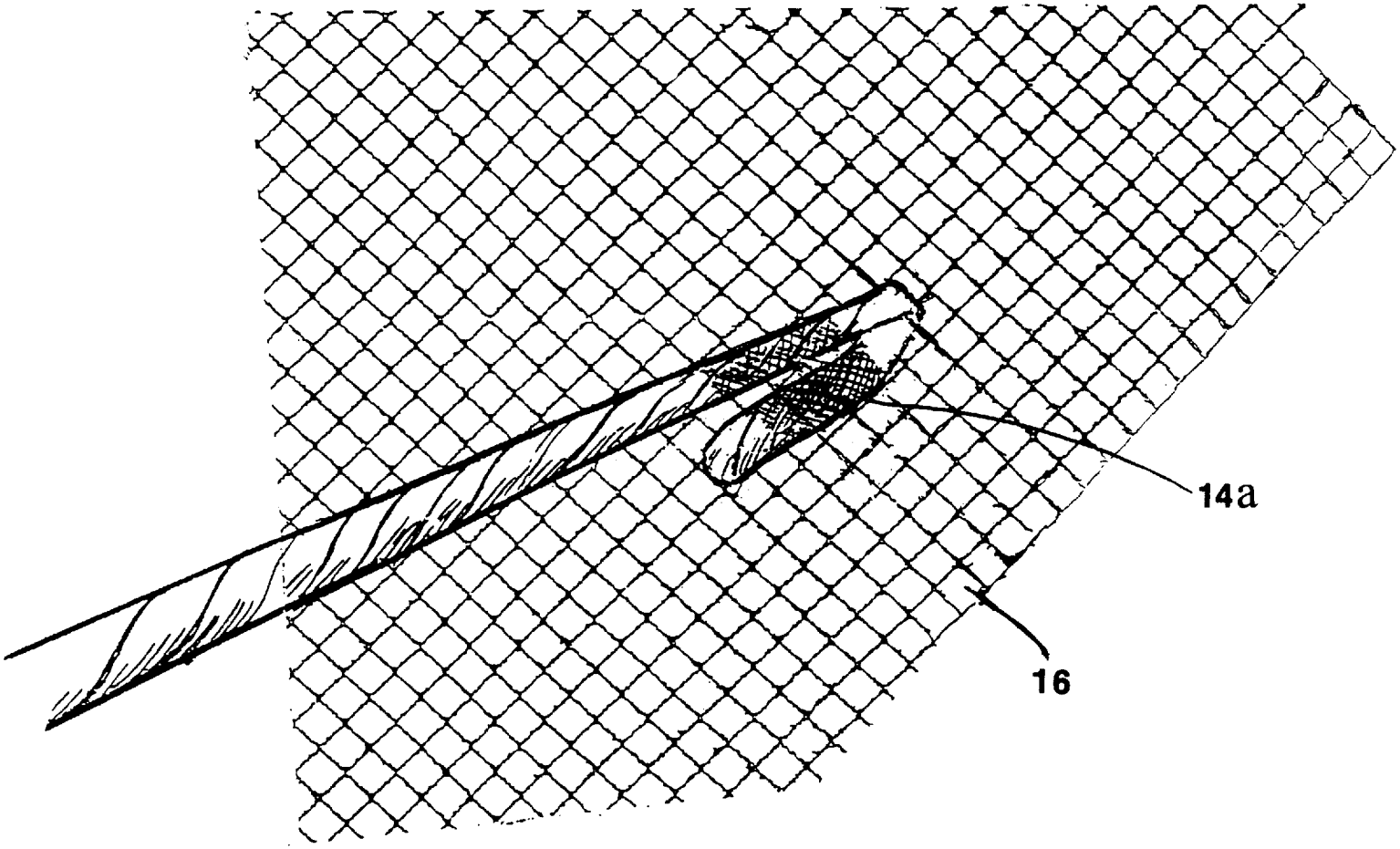
FIG. 8*d* shows the end of the tape shown in FIG. 8*a* wrapped around a portion of the wire in the backstop.
Figure 9:
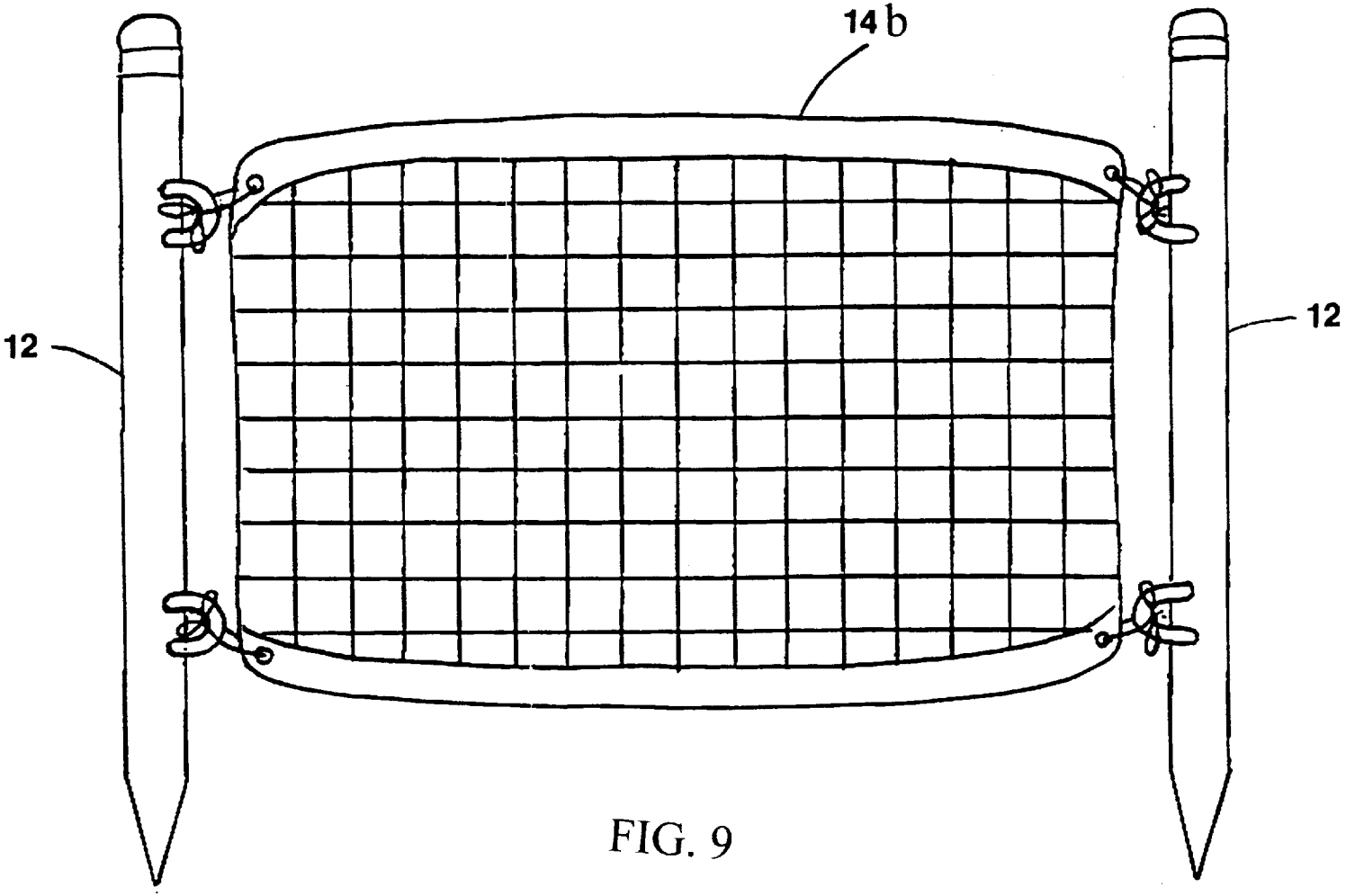
FIG. 9 shows another embodiment of the safety system in which a flexible mesh or screen is used instead of cord or tape.

As an alternative to the hooks used to fasten the ends of the tape 14*a* to either one another, the backstop, or one or more poles, the ends of the tape 14*a* may contain a swath 38 of hook or loop material on one side and complementary swath 40 of loop or hook material on the other. As shown in FIG. 8*c*, the end of the tape 14*a* may be wrapped around the top of a pole 12 so that the hook material on one side engages the loop material on the other. The ends of the tape 14*a* may similarly be secured around wire elements in the backstop 16, FIG. 8*d*, or to each other.

As a further alternative, two or more cords or tape segments can be used to isolate the on-deck area. For example, a cord or tape segment can be strung through each of the brackets 30*a* and 30*b* in the pole 12*a* shown in FIG. 6. Alternatively, a flexible screen, net, or mesh 14*b* can be hung from the bracket or similar structure attached to the pole, FIG. 9, or from the cord. These alternatives increase the size and effectiveness of the barrier to the on-deck area.

While the invention has been described and illustrated in connection with preferred embodiments, many variations and modifications as will be evident to those skilled in this art may be made without departing from the spirit and scope of the invention, and the invention as set forth in the appended claims is thus not to be limited to the precise details of methodology or construction set forth above as such variations and modification are intended to be included within the scope of the appended claims.

What is claimed is:

1. The combination of a baseball or softball playing field and a portable safety system for isolating an on-deck batter during a baseball or softball game, the safety system comprising:

three or more poles each having anchoring structure at a lower end thereof for removably supporting the pole in an upright position on or adjacent the playing field and having supporting structure at least about three feet from the extremity of the lower end for supporting one or more flexible elements passing therepast or terminating thereat in an assembled condition of the safety system;

one or more flexible elements; and a fastening system for releasably attaching one or more ends of the one or more flexible elements to the three or more poles, or to one another;

wherein the one or more flexible elements extend between adjacent poles and are supported by the three or more poles such that, in an assembled condition of the safety system, the one or more flexible elements enclose an on-deck area.

2. The combination of claim 1 wherein the playing field comprises soil in the on-deck area and the anchoring structure at the lower end of each pole comprises a lower end of the pole suitably configured to be removably forced into the soil.

3. The combination of claim 2 wherein the anchoring structure comprises an inverted cone shape of the lower end which may be wedged into the soil so as to support the pole in an upright position.

4. The combination of claim 1 wherein at least one of the poles has engaging structure which engages one or more of the flexible elements spaced longitudinally along the at least one pole as the flexible element or elements are wrapped along the at least one pole for storage.

5. The combination of claim 4 wherein the engaging structure comprises a pair of L-shaped hooks aligned in opposing directions near the upper and lower ends of the at least one pole.

6. The combination of claim 4 wherein the engaging structure comprises a pair of brackets positioned near the upper and lower ends of the at least one pole.

7. The combination of claim 1 wherein the supporting structure in each pole for supporting the one or more flexible elements comprises a hole in the pole through which the flexible element or elements may be inserted.

8. The combination of claim 1 wherein the supporting structure in each pole for supporting the one or more flexible elements comprises a bracket attached to the pole through which the flexible element or elements may be inserted or to which an end of a flexible element may be releasably fastened.

9. The combination of claim 1 wherein the supporting structure comprises a spring loaded roller attached to at least one pole which includes structure for attaching the end of a flexible element thereto, the spring-loaded roller allowing the flexible element to be withdrawn and automatically retracted.

10. The combination of claim 1 wherein the fastening system comprises a swath of hook material associated with at least one of at least two flexible elements and a swath of loop material associated with at least one other of the at least two flexible elements, such hook and loop material releasably engaging with one another.

11. The combination of claim 1 wherein the fastening system comprises a swath of hook material associated with one side of the one or more flexible elements and a swath of loop material associated with a reverse side of the one or more flexible elements, such hook and loop material releasably engaging with one another after an end of the one or more flexible elements is wrapped around a pole.

12. The combination of a baseball or softball playing field and a free-standing portable safety system for isolating an on-deck batter during a baseball or softball game, the safety system comprising:

three or more poles each having anchoring structure at a lower end thereof for removably supporting the pole in an upright position on or adjacent the playing field and having structure at least about three feet from the extremity of the lower end for supporting one or more flexible elements passing therepast or terminating thereat in an assembled condition of the safety system;

one or more flexible elements cumulatively having a length sufficient to enclose an on-deck area; and wherein at least one of the poles has structure which engages one or more of the flexible elements spaced longitudinally along the at least one pole as the flexible elements are wrapped along the at least one pole for storage.

13. The combination of claim 12 wherein the playing field comprises soil in the on-deck area and the anchoring structure at the lower end of each pole comprises a lower end of the pole suitably configured to be removably forced into the soil.

14. The combination of claim 12 further comprising a fastener system associated with at least one of the flexible elements and with at least one of the poles for fastening the at least one flexible element to the at least one pole.

15. The combination of claim 14 wherein the fastener system comprises a hook and eyelet which releasably engage.

16. The combination of claim 14 wherein the fastener system comprises a hook and loop comprising a swath of hook material and a swath of loop material that releasably engage.

17. The combination of claim 14 wherein the fastener system comprises a spring loaded roller attached to the at least one pole which includes structure for attaching the end of a flexible element thereto, the spring-loaded roller allowing the flexible element to be withdrawn and automatically retracted.

18. The combination of claim 12 further comprising a fastening system associated with at least two of the flexible elements for fastening the at least two flexible elements to one another.

19. The combination of claim 18 wherein the fastening system comprises a pair of interconnecting hooks attached at ends of the at least two flexible elements.

20. The combination of claim 18 wherein the fastening system comprises a swath of hook material associated with at least one of the at least two flexible elements and a swath of loop material associated with at least one other of the at least two flexible elements, such hook and loop material releasably engaging with one another.

21. A safety system part of which is portable for isolating an on-deck batter during a baseball or softball game, comprising in combination:

a preexisting upright structure on or adjacent a baseball or softball playing field adjacent to which is located an on-deck area large enough to contain at least one location at which a person can stand and swing a bat such that the bat does not extend beyond the on-deck area at any point in the swing;

one or more flexible elements which in cooperation with the preexisting upright structure, in an assembled condition of the safety system, define the on-deck area;

one or more portable poles;

at least three spaced points defining vertices of the on-deck area at at least one of which is arranged a pole, and at least one of which being located on the preexisting upright structure; and support means for supporting the one or more flexible elements from the one or more poles and support means for supporting the one or more flexible elements from at least one point on the preexisting upright structure such that the one or more flexible elements are suspended at least about three feet from the ground;

the one or more poles each comprising means for removably anchoring the pole in or on the ground such that the pole assumes a stable upright position.

22. The safety system of claim 21 wherein the support means comprises a swath of hook material attached to one side of the one or more flexible elements at ends thereof and a swath of loop material which releasably engages the hook material and which is attached to either the other side of the one or more flexible elements or to the one or more poles.

23. The safety system of claim 21 wherein the preexisting upright structure is a backstop.

24. The safety system of claim 23 wherein the means for supporting the one or more flexible elements from the preexisting upright structure comprises one or more hooks attached to an end or ends of the flexible element or elements and which releasably engage the backstop.

25. The safety system of claim 21 wherein the one or more poles comprises a single pole and the one or more flexible elements are supported by the single pole and two spaced apart points on the preexisting upright structure such that the on-deck area has a triangular configuration.

26. The safety system of claim 21 wherein the one or more poles comprises at least two poles and wherein the one or more flexible elements are supported by the at least two poles and by two spaced apart points on the preexisting upright structure such that the on-deck area has at least four sides.

27. The safety system of claim 21 wherein the one or more poles comprises at least two poles and wherein the one or more flexible elements are supported by the at least two poles and at a single point on the preexisting upright structure such that the on-deck area has a triangular configuration.

28. The safety system of claim 21 wherein at least one of the poles has engaging structure which engages one or more of the flexible elements spaced longitudinally along the at least one pole as the flexible element or elements are wrapped along the at least one pole for storage.

29. A portable safety system for isolating an on-deck batter during a baseball or softball game, comprising:

three or more poles each having anchoring structure at a lower end thereof for removably supporting the pole in an upright position on or adjacent the playing field and having supporting structure at least about three feet from the extremity of the lower end for supporting one or more flexible elements passing therepast or terminating thereat in an assembled condition of the safety system;

one or more flexible elements; and a fastening system for releasably attaching one or more ends of the one or more flexible elements to one or more poles, or to one another;

wherein the one or more flexible elements extend between poles and are supported by the three or more poles such that, in an assembled condition of the safety system, the one or more flexible elements enclose an on-deck area;

at least one of the poles having a pair of L-shaped hooks aligned in opposing directions near the upper and lower ends of the at least one pole which engage one or more of the flexible elements spaced longitudinally along the at least one pole as the flexible element or elements are wrapped along the at least one pole for storage.

30. The combination of a baseball or softball playing field and a safety system combination part of which is portable for isolating an on-deck batter during a baseball or softball game, the safety system combination comprising:

a preexisting upright structure on or adjacent the playing field adjacent to which is located an on-deck area large enough to contain at least one location at which a person can stand and swing a bat such that the bat does not extend beyond the on-deck area at any point in the swing;

one or more flexible elements which in cooperation with the preexisting upright structure in, in an assembled condition of the safety system, define the on-deck area;

one or more portable poles, at least three spaced points defining vertices of the on-deck area at at least one of which is arranged a pole and at least one of which being located on the preexisting upright structure; and support means for supporting the one or more flexible elements from the one or more poles and at least one point on the preexisting upright structure such that the one or more flexible elements are suspended at least about three feet from the ground;

the one or more poles each comprising means for removably anchoring the pole in or on the ground such that the pole assumes a stable upright position.

31. The combination of a baseball or softball playing field and a portable safety system for isolating an on-deck batter during a baseball or softball game, the portable safety system comprising:

three or more poles each having anchoring structure at a lower end thereof for removably supporting the pole in an upright position on or adjacent the playing field and having supporting structure at least about three feet from the extremity of the lower end for supporting one or more flexible elements passing therepast or terminating thereat in an assembled condition of the safety system;

one or more flexible elements; and a fastening system for releasably attaching one or more ends of the one or more flexible elements to one or more poles, or to one another;

wherein the one or more flexible elements extend between poles and are supported by the three or more poles such that, in an assembled condition of the safety system, the one or more flexible elements enclose an on-deck area;

at least one of the poles having structure projecting transversely therefrom near the upper and lower ends of the at least one pole which engage one or more of the flexible elements spaced longitudinally along the at least one pole as the flexible element or elements are wrapped along the at least one pole for storage.

* * * * *